US010426232B2

(12) United States Patent
Howard et al.

(10) Patent No.: US 10,426,232 B2
(45) Date of Patent: Oct. 1, 2019

(54) ZIP FASTENER

(71) Applicant: RAW IP LIMITED, Winchester Hampshire (GB)

(72) Inventors: Wendy Rose Howard, Winchester (GB); Andrew Michael Honour, Amersham (GB); Raymond David Pitman, Tring (GB)

(73) Assignee: RAW IP Limited (GB)

( * ) Notice: Subject to any disclaimer, the term of this patent is extended or adjusted under 35 U.S.C. 154(b) by 309 days.

(21) Appl. No.: 14/901,435

(22) PCT Filed: Jul. 1, 2014

(86) PCT No.: PCT/GB2014/051989
§ 371 (c)(1),
(2) Date: Dec. 28, 2015

(87) PCT Pub. No.: WO2015/001328
PCT Pub. Date: Jan. 8, 2015

(65) Prior Publication Data

US 2016/0183641 A1 Jun. 30, 2016

(30) Foreign Application Priority Data

Jul. 1, 2013 (GB) ..... 1311761.9

(51) Int. Cl.
*A44B 19/08* (2006.01)
*A41H 37/00* (2006.01)
(Continued)

(52) U.S. Cl.
CPC ..... *A44B 19/08* (2013.01); *A41H 37/003* (2013.01); *A44B 19/00* (2013.01); *A44B 19/26* (2013.01); *A44B 19/34* (2013.01); *A44B 19/403* (2013.01)

(58) Field of Classification Search
CPC ..... Y10T 24/2555; Y10T 24/2552; Y10T 24/2554; Y10T 24/2514; A44B 19/08; A44B 19/403; A44B 19/34
See application file for complete search history.

(56) References Cited

U.S. PATENT DOCUMENTS 1,864,614 A 6/1932 Poux
2,032,438 A 3/1936 Riecken
(Continued)

FOREIGN PATENT DOCUMENTS

CN 1078125 A 11/1993
CN 1147356 A 4/1997
(Continued)

OTHER PUBLICATIONS

"Search Report" of the U.K. Intellectual Property Office in U.K. Patent Application No. GB1311761.9, dated Dec. 20, 2013 (3 pages).
(Continued)

*Primary Examiner* — Abigail E Troy
(74) *Attorney, Agent, or Firm* — Tumey L.L.P.

(57) ABSTRACT

A zip fastener (10) comprises two opposed sets of teeth (14) which are shaped such that those on one set (12*a*) can fit between those on the other set (12*b*). At least some adjacent teeth of opposed sets (12*a*, 12*b*) have facing surfaces (17*a*, 17*b*) shaped so as engage and to inhibit lateral separation of the sets, and such that each tooth can undergo at least limited angular movement relative to the adjacent tooth. The teeth (14) within a set (12) are held at a predetermined spacing along the set by linking strips (16) aligned generally along the center line of the set (12). Each tooth (14) defines a strip location (20) facing the opposed set of teeth, such that the linking strip (16) on one set (12*a*) fits in the strip location (20) on the other set (12*b*). Since the tooth spacing is set by
(Continued)

the linking strips (16), the sets (12) of teeth (14) can lie on a curved path.

15 Claims, 7 Drawing Sheets

(51) Int. Cl.

| | |
|---|---|
| ***A44B 19/00*** | (2006.01) |
| ***A44B 19/34*** | (2006.01) |
| ***A44B 19/40*** | (2006.01) |
| ***A44B 19/26*** | (2006.01) |

(56) References Cited

U.S. PATENT DOCUMENTS

| | | | |
|---|---|---|---|
| 2,073,380 | A | 3/1937 | Roseman |
| 2,087,456 | A | 7/1937 | Sundback |
| 2,119,352 | A | 5/1938 | Puc |
| 2,295,976 | A | 9/1942 | Suskowitz et al. |
| 2,380,623 | A | 7/1945 | Winterhalter |
| 2,438,614 | A | 3/1948 | Morin |
| 2,654,930 | A | 10/1953 | Rakowitzky |
| 2,799,070 | A | 7/1957 | Weber |
| 2,932,872 | A | 4/1960 | Geissmann |
| 2,933,792 | A | 4/1960 | Malmborg |
| 2,971,200 | A | 2/1961 | Lindsay |
| 2,989,802 | A | 6/1961 | McNamara |
| 3,001,904 | A | 9/1961 | Porepp |
| 3,225,429 | A | 12/1965 | Fady |
| 3,456,306 | A | 7/1969 | Heimberger |
| 3,488,239 | A | 1/1970 | Heimberger |
| 3,490,098 | A | 1/1970 | Frohlich |
| 3,497,926 | A | 3/1970 | Frohlich |
| 3,872,551 | A | 3/1975 | Moertel |
| 3,991,795 | A | 11/1976 | Bainer |
| 4,100,656 | A | 7/1978 | Moertel |
| 4,238,872 | A | 12/1980 | Akashi |
| 4,455,722 | A | 6/1984 | Oda |
| 5,329,674 | A | 7/1994 | Tomita et al. |
| 5,628,094 | A | 5/1997 | Mizuno |
| 5,898,979 | A | 5/1999 | Hamada |
| 6,230,373 | B1 | 5/2001 | Wakai et al. |
| 6,490,770 | B1 | 12/2002 | Matsuda et al. |
| 6,530,132 | B2 | 3/2003 | Yamagishi et al. |
| D558,091 | S | 12/2007 | Cossutti |
| D579,379 | S | 10/2008 | Lin |
| D631,790 | S | 2/2011 | Keyaki et al. |
| D643,776 | S | 8/2011 | Keyaki et al. |
| D643,779 | S | 8/2011 | Di Girolami et al. |
| D655,645 | S | 3/2012 | Gut |
| 8,752,253 | B2 | 6/2014 | Sato |
| 8,800,118 | B2 | 8/2014 | Takasawa |
| 8,973,223 | B2 | 3/2015 | Blackford et al. |
| 9,398,789 | B2 | 7/2016 | Blackford |
| 2002/0050030 | A1 | 5/2002 | Takasawa |
| 2002/0108218 | A1 | 8/2002 | Chen |
| 2004/0231115 | A1 | 11/2004 | Keyaki et al. |
| 2007/0022579 | A1 | 2/2007 | Akashi et al. |
| 2007/0163091 | A1 | 7/2007 | Bernasconi |
| 2007/0226965 | A1 | 10/2007 | Cossutti |
| 2008/0066270 | A1 | 3/2008 | Takasawa et al. |
| 2008/0086851 | A1 | 4/2008 | Miyazaki |
| 2009/0049659 | A1 | 2/2009 | Takani et al. |
| 2010/0154179 | A1 | 6/2010 | Blackford et al. |
| 2010/0192332 | A1 | 8/2010 | Blackford et al. |
| 2011/0005042 | A1 | 1/2011 | Thomas et al. |
| 2012/0180272 | A1 | 7/2012 | Takani |
| 2012/0233739 | A1 | 9/2012 | Blackford |
| 2012/0260468 | A1 | 10/2012 | Nozaki |
| 2013/0232738 | A1 | 9/2013 | Tominaga et al. |
| 2015/0223572 | A1 | 8/2015 | Wang |

FOREIGN PATENT DOCUMENTS

| | | | |
|---|---|---|---|
| CN | 1415256 | A | 5/2003 |
| EP | 1201144 | A2 | 2/2002 |
| EP | 1192871 | A2 | 4/2002 |
| FR | 1238223 | | 7/1960 |
| GB | 2420827 | A | 6/2006 |
| JP | S5729303 | | 2/1982 |
| JP | H4138304 | | 12/1992 |
| JP | H09037817 | | 2/1997 |
| JP | 2002101917 | A | 4/2002 |
| JP | 2002136310 | A | 5/2002 |
| JP | 2007089898 | A | 4/2007 |
| NL | 95496 | | 4/1960 |
| TW | M306795 | | 3/2007 |
| WO | 2012105025 | A1 | 8/2012 |
| WO | 2015001328 | A1 | 1/2015 |

OTHER PUBLICATIONS

"International Search Report" and "Written Opinion" of the International Searching Authority (ISA/EP) in RAW IP Limited, International Patent Application Serial No. PCT/GB2014/051989, dated Sep. 4, 2014 (15 pages).

Fig.12.
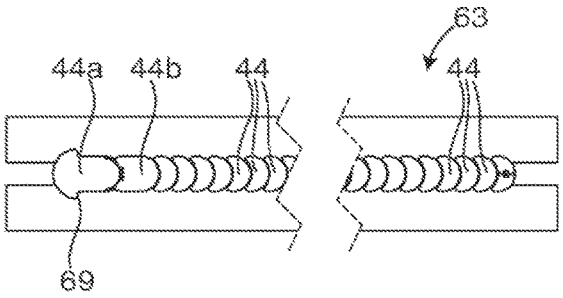
Fig.13a. Fig.13b. Fig.13c. Fig.13d.
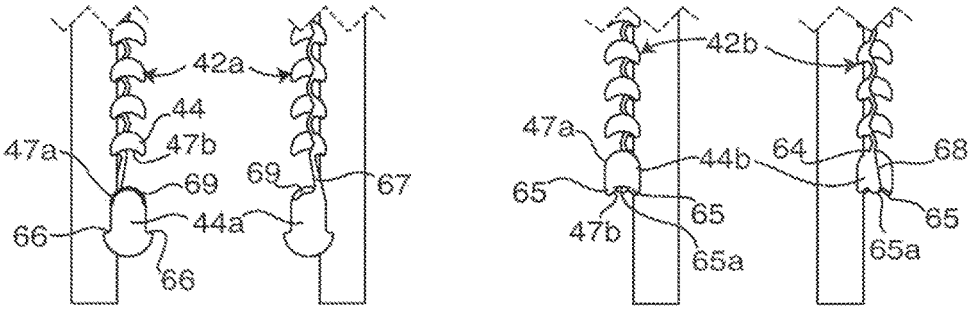
Fig.14.
Fig.15.
Fig.16.
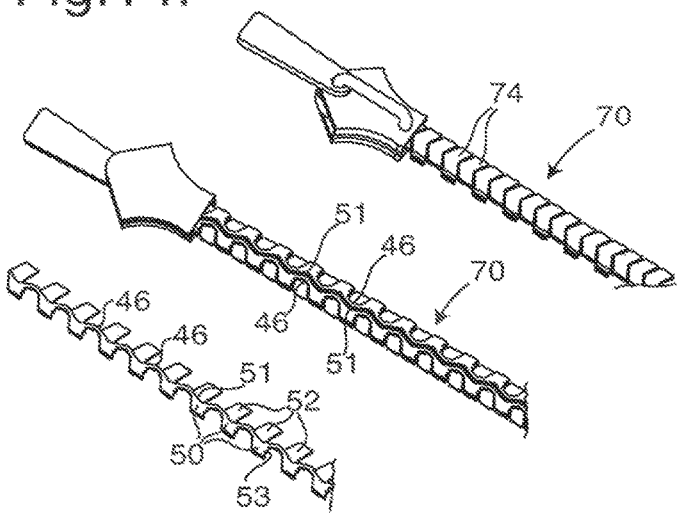

ZIP FASTENER

CROSS REFERENCE TO RELATED APPLICATIONS

This application is the U.S. national stage application under 35 U.S.C. § 371 of co-pending International Application No. PCT/GB2014/051989, filed Jul. 1, 2014 and designating the U.S., which published as WO 2015/001328 A1 on Jan. 8, 2015, and which claims the benefit of United Kingdom Patent Application No. GB 1311761.9, filed Jul. 1, 2013. Each of the foregoing patent applications and patent application publications is expressly incorporated by reference herein in its entirety.

The invention relates to a zip fastener, that is to say a fastener comprising two opposed sets of teeth that can interlock, and to a way of making such a zip fastener.

Zip fasteners are widely used on garments, on tents and sail covers, on bags and suitcases, and indeed in many other contexts in which fabrics and other materials (e.g. leather and plastics) are to be joined together. Conventional zip fasteners comprise two opposed sets of teeth that are attached to the edges of respective fabric steps, the fabric strips holding the teeth at a fixed spacing. The zip fastener also includes a slider which when moved in one direction slides the teeth one-by-one into an interlocking position, and when moved in the opposite direction slides the teeth one-by-one apart. Such a conventional sip fastener is satisfactory in a wide range of applications, but can only follow a path which is straight or only slightly curved in the plane of the fabric strips, because to follow a curved path would require one of the fabric strips to become longer and the other fabric strip to become shorter.

According to the present invention there is provided a zip fastener comprising two opposed sets of teeth; the teeth being shaped such that the teeth on one set can fit between the teeth on the other set, at least some adjacent teeth of opposed sets having facing surfaces shaped so as engage and to inhibit separation of the sets, such that when the teeth fit together the shaped facing surface on one tooth is adjacent to the shaped facing surface of an adjacent tooth that engages with it to inhibit separation, and such that each tooth can undergo at least limited angular movement relative to the adjacent tooth; wherein the teeth within a set are held at a predetermined spacing along the set by linking strips aligned generally along the centre line of the set of teeth; and wherein each tooth defines a strip location facing the opposed set of teeth, such that the linking strip on one set of teeth can locate in the strip location on the other set of teeth.

In one embodiment all the teeth have a convex front surface and a concave rear surface, these constituting the engaging facing surfaces of adjacent teeth. In another embodiment, shaped facing surfaces that engage to inhibit separation are provided on only the front surfaces of one set of teeth, and only the rear surfaces of the other set of teeth. When the sets of teeth are fitted together, pairs of faces that engage to inhibit separation alternate with pairs of faces that contact each other, but do not engage to inhibit separation. In another embodiment all the teeth of one set have convex front surfaces and convex rear surfaces, while all the teeth of the other set have concave front surfaces and concave rear surfaces. In every case the teeth can undergo at least limited angular rotation relative to the adjacent teeth while the zip fastener remains closed, and can move angularly in either direction relative to the centre line, for example through an angle between 10° and 30°. Hence the fastener can extend along a line that is curved even when the zip fastener is closed.

In plan view, all the teeth may have the same shape. In another option the teeth of one set may be of a different shape to those on the other set; and as another option the teeth of one set may be of a different size to those on the other set. In plan view the shape of each tooth may be symmetrical, or may be asymmetrical.

The linking strips and the teeth of one set may be integral with each other, for example being produced by injection moulding as a single item. Alternatively the linking strips may be a continuous strip, onto which the teeth are attached; this would enable the linking strips to be of a more flexible material, or a stiffer material, than that of the teeth. In some cases the linking strips may be integral with a carrier tape or fabric strip.

The restricted angular movement of one tooth relative to the adjacent tooth may be achieved by providing gaps between the adjacent teeth, at least along their edges. The front surface and rear surface may be curved so as to engage, for example with a cylindrical curved surface. For example the facing surfaces may be convex on one tooth and concave on an adjacent tooth; alternatively the facing surfaces may be partly convex and partly concave on one tooth, and partly concave and partly convex on an adjacent tooth that engages with it; and as another alternative they may have a polygonal shape, for example a chevron shape in plan.

The zip fastener also requites a slider. When the slider is moved along the zip fastener in one direction it slides the teeth one-by-one into an interlocking position, and when moved in the opposite direction it slides the teeth one-by-one apart. The gap between the edges of adjacent teeth is such that successive teeth can be slid together or slid apart by changing the orientation of the teeth relative to the line of the closed zip fastener. Consequently the slider is arranged to change the orientation of the teeth relative to the line of the closed zip fastener, both when opening and closing the zip. For opening the zip, the slider incorporates a wedge or cam element to help push opposed teeth apart; the shape of this wedge element may be founded or angular, depending on the shape of the teeth.

The wedge or cam element may act on a surface of the linking strip or a step-like surface feature of a tooth. The orientation of the surface against which the wedge or cam element acts may be the equivalent of an inclined plane, so increasing the mechanical advantage of the cam or wedge element in opening the zip fastener. This can enable generation of a large angular displacement of adjacent teeth passing through the slider, so allowing for a large outer tooth surface, which may be used for decorative effects; and the possibility of a shorter slider wedge that can pass around tight curves. Indeed there could be multiple different teeth with different shapes within a single zip fastener. For each tooth the shape or orientation of the surface against which the wedge or cam element acts, for example the shape of the step on the underside, may be such as to provide an appropriate mechanical advantage when disengaging that tooth from the adjacent tooth.

Since the wedge is not acting on the outer surface of the tooth, there is considerable freedom of design as regards the outer profile.

The slider may also include guide rails acting on the outer surfaces of the teeth, which may guide the teeth during closing of the zip fastener, if the teeth of the opposed sets are of different sizes, the guide rails within the slider may be asymmetrically disposed relative to the centre line of the zip fastener, to ensure the teeth are brought into engagement.

The strip locations of a set of teeth may be on the under surface or the top surface of the teeth, adjacent to the linking strips of the set of teeth. In this arrangement, when the zip fastener is closed, i.e. with the teeth interlocked, the linking strips of the two sets of teeth may therefore extend side by side along the centre line of the zip fastener, in an alternative arrangement the strip locations of a set of teeth are defined by slots in the side of the teeth. In this arrangement, when the zip fastener is closed, i.e. with the teeth interlocked, the linking strips of the two sets of teeth may extend side by side along the centre line, or may extend one above the other along the centre line of the fastener.

The linking strips between successive teeth may lie on a substantially continuous curved or straight line, on or parallel to the centre line of the zip fastener when closed. In an alternative embodiment each linking strip may be at a small angle to the centre line of the zip fastener, when closed, so the linking strips follow a slight zigzag. This small angle is preferably less than 30°, and for example may be 15° or 20°. The linking strips may each follow a shallow V between one tooth and the next, which may be symmetrical or asymmetrical. At least some of the linking strips may be curved along their length. In the case in which the linking strips and the steps on the teeth define a continuous zigzag path, the shape of the zigzag may be designed to suit the interlocking profile of the teeth, as in some cases the teeth of one set may require a different angle of rotation to the teeth of the other set, and this can be achieved by having successive sections of this zigzag path having different orientations, so effectively acting as different inclined planes.

When the zip fastener is closed, with the linking strips on one set of teeth filling in the strip locations on the other set of teeth, each linking strip may lie against a surface with the same longitudinal profile. This ensures that the longitudinal separation of the teeth will not vary.

Each tooth may also define means for attachment to a fabric on its outside face, i.e., the face facing away from the other set of teeth, for example a slot or a tab.

Since the teeth are held at a fixed spacing by the linking strips, and the linking strips lie on or immediately adjacent to the centre line of the zip fastener, when closed, the zip fastener can follow a curved path in the plane of the fabric. So for example the zip fastener may be used to join two fabrics together along a curved line, for example following a C-curve or an S curve.

In a further aspect of the present invention there is provided a method of making a zip fastener, in which the requisite sets of teeth and linking strips are attached to respective fabric strips. At least one of the fabric strips may be stretched from its relaxed length before attaching the set of teeth and linking strips, so that the relaxed length of that fabric strip is less than the relaxed length of the set of teeth and linking strips.

It will be appreciated that in conventional zip fasteners, each tooth can rotate only in one direction, towards the fabric to which it is attached, to allow successive teeth to disengage; and this angular rotation can happen only if the preceding tooth has already been disengaged. Consequently when the conventional zip fastener is closed, it is substantially stiff, and follows a straight line. In contrast, in the zip fastener of the present invention, each tooth can rotate to at least a limited extent in each direction relative to the centre line, even when the zip fastener is closed. Consequently the sip fastener is not stiff, and can be curved to follow a desired curved path. The shape of the centre line may be held by that of the fabric to which the zip fastener is attached. Nevertheless, when the zip fastener is to be disengaged, the teeth can be successively disengaged in substantially the same way as with the conventional zip fastener.

The invention will now be further and more particularly described, by way of example only, and with reference to the accompanying drawings in which.

Figure 1:
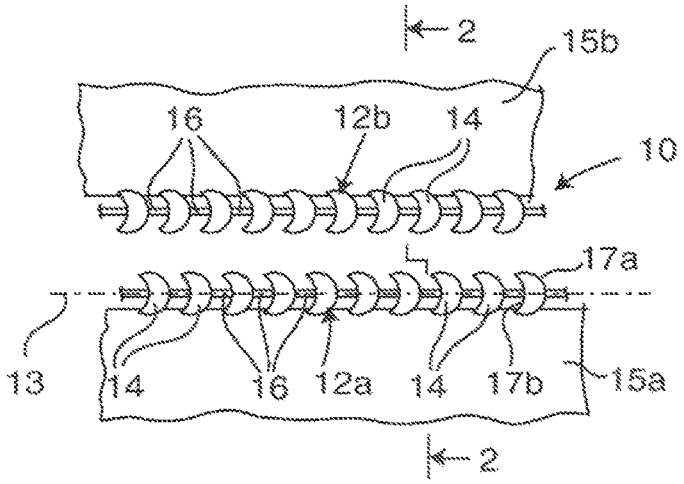
FIG. 1 shows a plan view of two opposed sets of teeth which form part of a zip fastener.
Figure 4A:
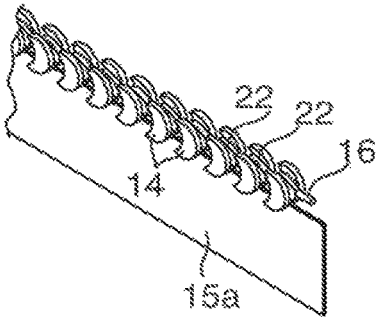
Figure 4B:
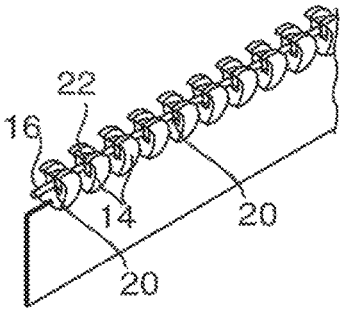
Figure 5:
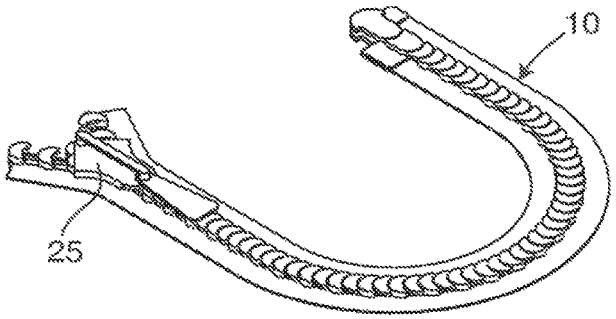
Figure 6A:
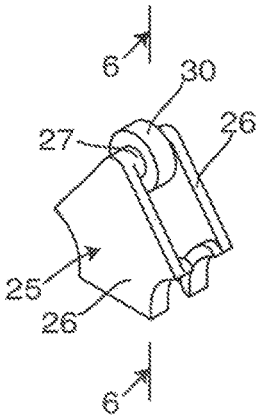

FIG. 4*a* and FIG. 4*b* show perspective views of a set of teeth of the fastener of FIG. 1, viewed from the convex side, and from the concave side;

FIG. 5 shows a perspective view of the fastener of FIG. 1, in a curved shape;

FIG. 8*a* shows a perspective view of a slider of the zip fastener of FIG. 1;

FIG. 8*b* snows a sectional view on the line 6-6 of FIG. 6*a;*

Figure 7:
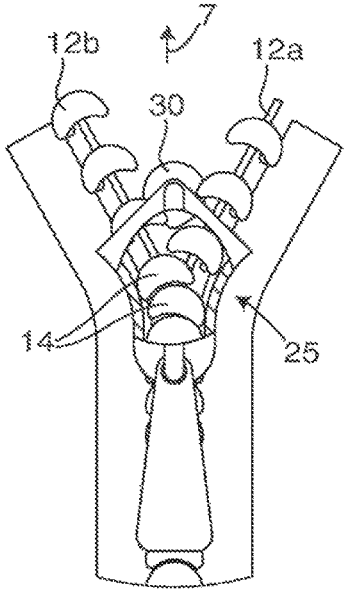
Figure 8:
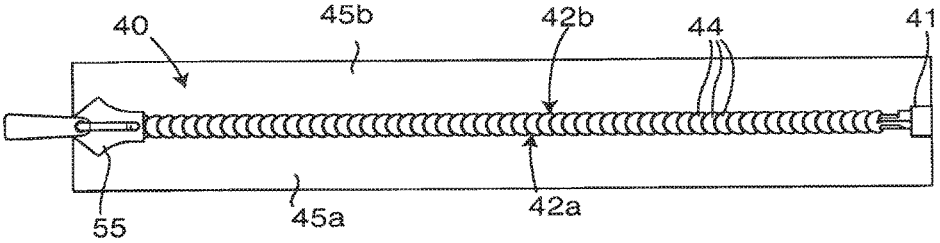
Figure 9:
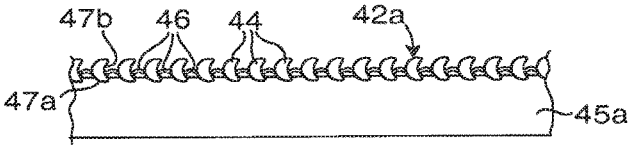
Figure 10:
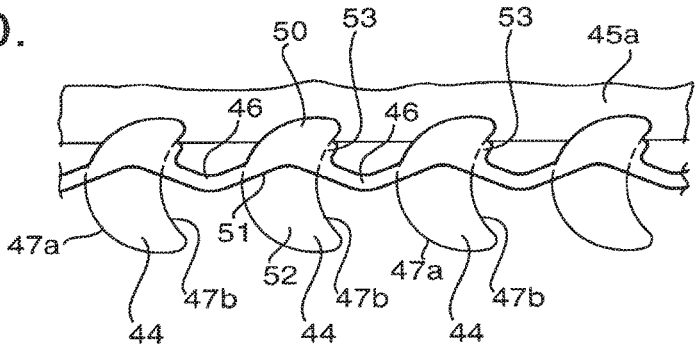
Figure 11A:
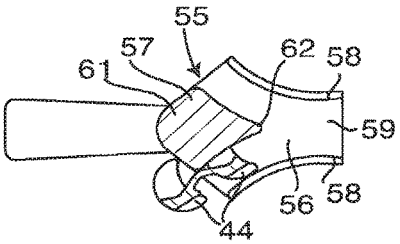
Figure 11B:
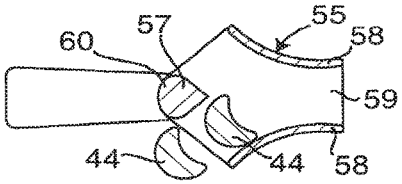
Figure 17:
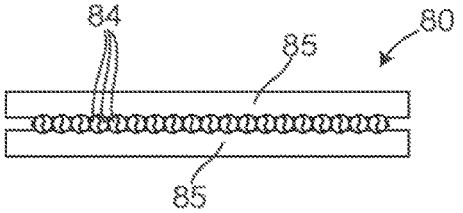
Figure 18:
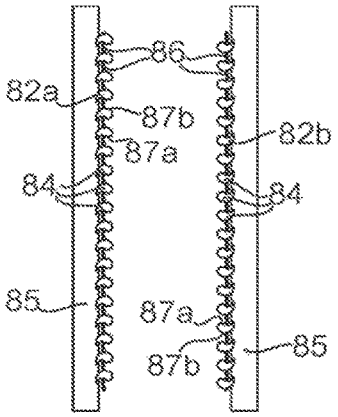
Figure 19:
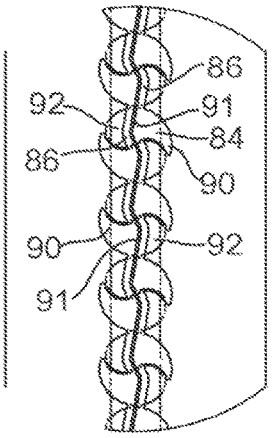
Figure 20:
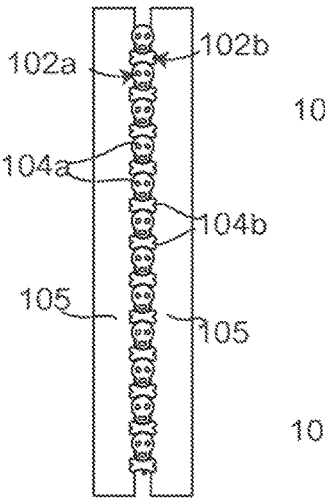
Figure 21:
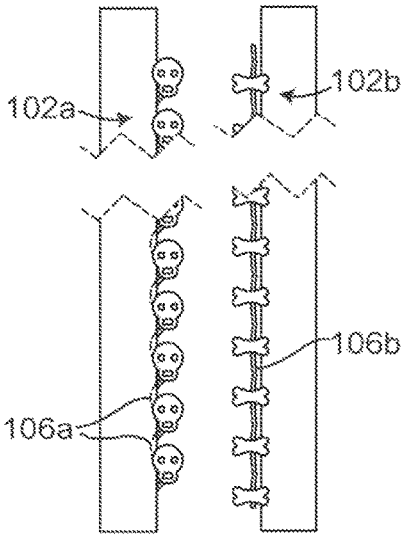
Figure 22:
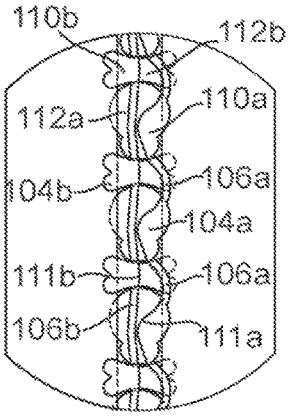
Figure 23:
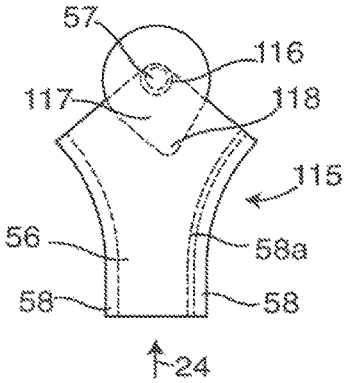
Figure 24:
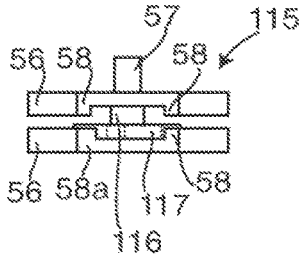
Figure 25:
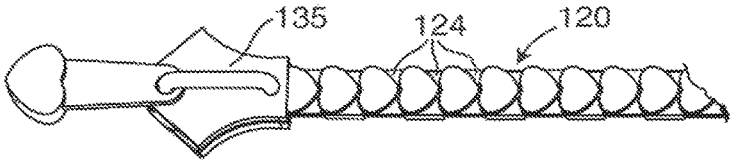
Figure 26:
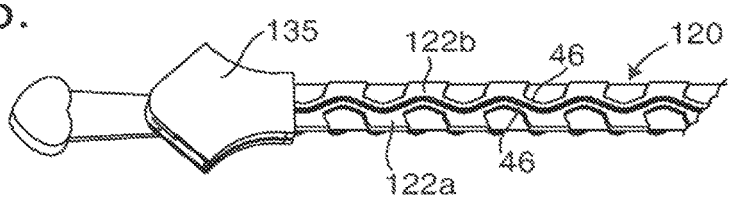
Figure 27A:
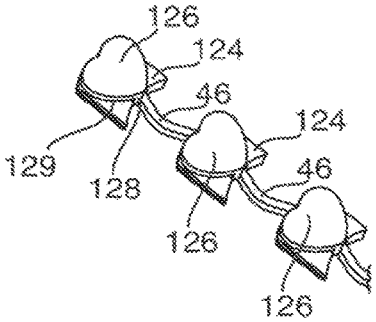
Figure 27B:
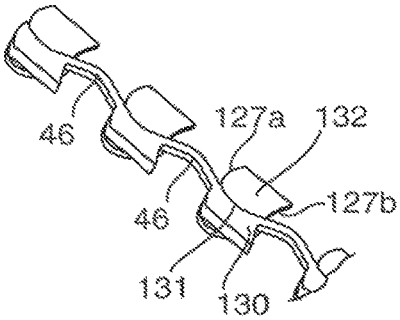
Figure 28:
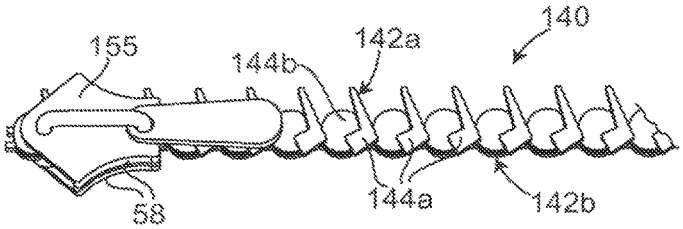
Figure 29:
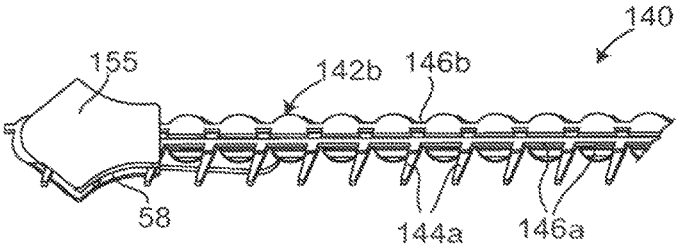
Figures 30A, 30B:
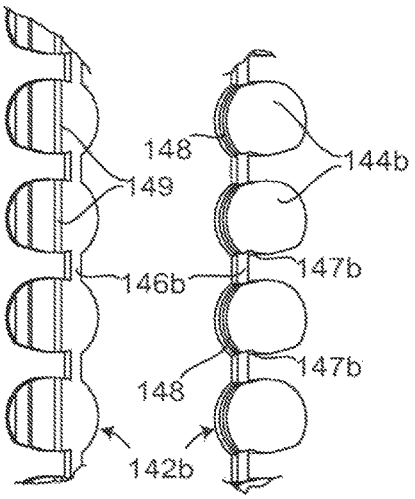
Figures 30C, 30D:
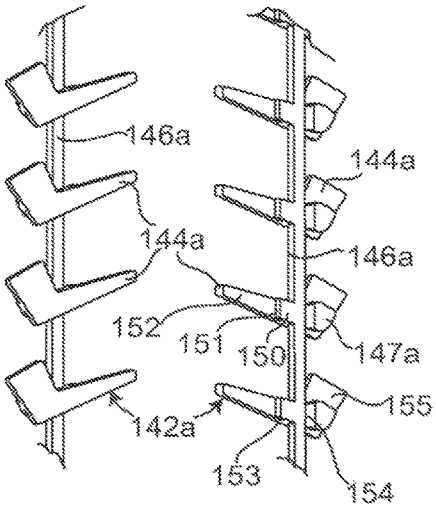

FIG. 7 shows a plan view, partly cut away, of the slider of the zip fastener of FIG. 1, during operation;

FIG. 8 shows a plan view of a second zip fastener, in the closed position;

FIG. 9 shows a plan view of a set of teeth of the zip fastener of FIG. 8;

FIG. 10 snows a view of the underside of the set of teeth of FIG. 9, to a larger scale;

FIGS. 11*a* and 11*b* show sectional views of a slider of the zip fastener of FIG. 8;

FIG. 12 shows a plan view of a modification to the zip fastener of FIG. 8;

FIGS. 13*a* and 13*c* show plan views of the sets of teeth of the zip fastener of FIG. 12;

FIGS. 13*d* and 13*d* show underside views of the sets of teeth of the zip fastener of FIG. 12;

FIG. 14 shows a perspective view of a third zip fastener, in the closed position;

FIG. 15 shows a perspective view of the zip fastener of FIG. 14, showing the underside;

FIG. 16 shows a perspective view of one set of teeth of the zip fastener of FIG. 14;

FIG. 17 shows a plan view of a fourth zip fastener, in the closed position;

FIG. 18 shows a plan view of the two sets of teeth of the fastener of FIG. 17, separated;

FIG. 19 shows a detail view of the underside of the fastener of FIG. 17;

FIG. 20 shows a plan view of a fifth zip fastener, in the closed position;

FIG. 21 shows a plan view of the two sets of teeth of the fastener of FIG. 20, separated;

FIG. 22 shows a detail view of the underside of the fastener of FIG. 20;

FIG. 23 shows an underside view of a slider of the fastener of FIG. 20;

FIG. 24 shows an end view of the slider of FIG. 23;

FIG. 25 shows a perspective view from above of a sixth zip fastener, in the closed position;

FIG. 26 shows a perspective view of the underside of the zip fastener of FIG. 25;

FIGS. 27*a* and 27*b* show perspective views from above and below of a set of teeth of the zip fastener of FIG. 25;

FIG. 28 shows a perspective view from above of a seventh zip fastener, in the closed position;

FIG. 29 shows a perspective view of the underside of the zip fastener of FIG. 28;

FIGS. 30*a* and 30*b* show perspective views from below and above of one set of teeth of the rip fastener of FIG. 28; and FIGS. 30*c* and 30*d* show perspective views from above and below of the other set of teeth of the zip fastener of FIG. 28.

Referring now to FIG. 1, a zip fastener 10 consists of two opposed sets 12*a* and 12*b* of teeth 14. Although the sets 12*a* and 12*b* are shown as extending in a straight line, they can equally well follow a curved line. Along the outer edges of the sets 12*a* and 12*b* the teeth 14 are attached to respective pieces of fabric 15*a* and 15*b*, which the zip fastener 10 can join together. The fabric 15*a*, 15*b* may be stretchable, as it does not hold the teeth 14 in position; the opposed edges of the pieces of fabric 15*a* and 15*b* may be cut along straight lines, as shown, or alternatively may be cut along a curved line. The teeth 14 are held at a fixed spacing by linking strips 16 along the centre line 13 of the set 12*a* or 12*b* (only the centre line 13 of the set 12*a* is shown, represented by a chain dotted line).

In plan view each tooth 14 has a convex front face 17*a* and a concave rear face 17*b*, which in this example are of substantially the same radius of curvature; that is to say the front face 17*a* and the rear face 17*b* are shaped as parts of cylinders. When the zip fastener 10 is closed, the teeth 14 of one set 12*a* fit between the successive teeth 14 of the other set 12*b*. The spacing between successive teeth 14 is sufficient to allow some play, so that one tooth 14 can move angularly relative to the adjacent tooth through at least a limited angle, typically no more than 30°, in either direction relative to the centre line 13, while the zip fastener 10 remains closed.

Figure 2:
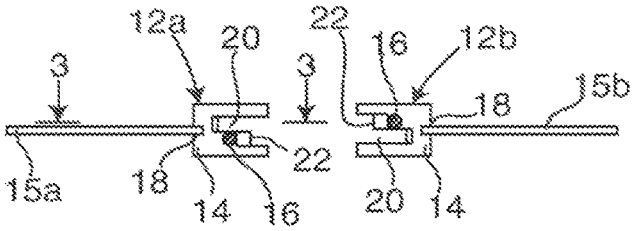
FIG. 2 shows a sectional view on the line 2-2 of FIG. 1, showing two teeth of the opposed sets in elevation.
Figure 3:
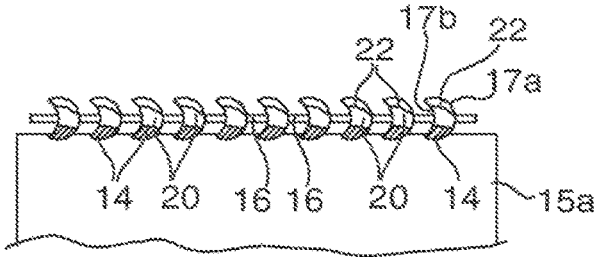
FIG. 3 shows a sectional view of one set of teeth, on the line 3-3 of FIG. 2.

As shown in FIG. 2, the pieces of fabric 15*a* and 15*b* locate in narrow slits 18 along the outer edges of the teeth 14. Referring also to FIGS. 3 to 5, each tooth 14 defines a slot 20 facing the opposed set 12 of teeth 14, the slot 20 (as shown in FIG. 3) extending slightly beyond the line defined by successive linking strips 16. In the set 12*a* the slot 20 is above (as shown) the line of the linking strips 16, whereas in the set 12*b* the slot 20 is below the line of the linking strips 15. The slot 20 is sufficiently wide to locate a linking strip 16. The outermost part of the slot 20 is significantly wider, as there is a step 22 in the wall of the slot 20 adjacent to the portion of the tooth 14 aligned with the linking strips 16. As seen in FIG. 3, the step 22 follows a convex curve, and defines a bearing surface.

In this zip fastener 10, the teeth 14 of the set 12*a* and the teeth of the set 12*b* are of the same shape, merely rotated around the centre line through 180°.

As shown in FIG. 5, the zip fastener 10 can follow a curved path. The zip fastener 10 also includes a slider 25 so it can be opened and closed.

Figure 6B:
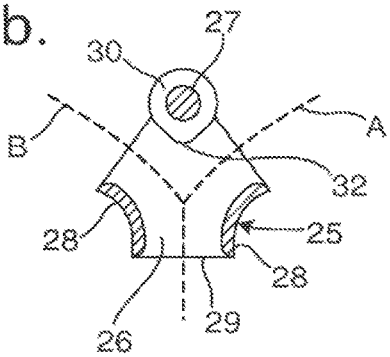

Referring now to FIGS. 8*a*, 6*b* and 7, the zip fastener 10 also requires a slider 25, through which the sets 12*a* and 12*b* pass along the paths shown as broken lines A and B in FIG. 6*b*; the relative displacement of the teeth 14 during operation of the slider 25 is shown in FIG. 7. The slider 25 consists of two arrowhead-shaped guide plates 26 linked by a rod 27 at the top end (as shown), and the lower portions of the guide plates 26 define curved internal flanges 28. The width of the gap 23 between the opposite flanges 28 is equal to the width of the teeth 14, so the closed zip fastener 10 can fit through the gap 29. Mounted at the midpoint of the rod 27 a generally circular cam 30 with a rounded protrusion 32 facing downwards (as shown). These components are all integral.

When the slider 25 is moved in one direction (upwards, as shown, in the direction of the arrow 7), the two sets 12*a* and 12*b* of teeth 14 are meshed together, each tooth 14 being caused to change its orientation as it follows the curved path A or B, and so to move angularly into engagement with adjacent teeth 14 on the other set. This therefore closes the zip fastener 10. When the slider 26 is moved in the opposite direction, the rounded protrusion 32 and the circular cam 30 pushes on the beating surface defined by the step 22 or each successive tooth 14, and so pushes the teeth 14 of the two sets 12*a* and 12*b* apart. This therefore opens the zip fastener 10.

When the top fastener 10 is closed, the linking strips 16 of one set 12*a* or 12*b* fit into the slots 20 of the opposite set 12*b* or 12*a*. Hence the lines defined by the linking strips 16 of the two sets 12*a* and 12*b* both extend down the centre line 13 of the fastener 10 (when closed), one line being directly above the other.

It will be appreciated that the linking strips 16 must be sufficiently flexible to allow the sets 12*a* and 12*b* to follow the curved paths A and B during opening or closing of the zip fastener 10, and indeed to allow the zip fastener 10 to follow a curved path (as shown in FIG. 5, rather than the straight line shown in FIG. 1). The linking strips 16 may be integral with the teeth 14, and of the same material. Alternatively, the linking strips 16 may form portions of a continuous strip that extends the entire length of the set 12*a* or 12*b*, through all the teeth 14, the teeth 14 being fixed onto that continuous strip at appropriate positions, for example by moulding or by adhesive. In this case the linking strips 18 may be of a different material to the teeth 14.

In a modification, the linking strips 18 may form the edges of the strips of fabric 15*a* and 15*b*. In this case the narrow slits 18 would have to extend slightly different planes, to line up with the positions of the linking strips 16 as shown in FIG. 2.

Referring now to FIG. 8, this shows a plan view of an alternative zip fastener 40 in the closed position. (In this closed position, the plan view of the zip fastener 10 and of the zip fastener 40 are substantially identical.) The zip fastener 40 consists of two opposed sets 42*a* and 42*b* of teeth 44 which are joined together at one end 41. Although the sets 42*a* and 42*b* are shown as extending in a straight line, they can also follow a curved line. Along the outer edges of the sets 42*a* and 42*b* the teeth 44 are attached to respective pieces of fabric 45*a* and 45*b*, which the zip fastener 40 can join together. The fabric 45*a*, 45*b* may be stretchable, as it does not hold the teeth 44 in position; the opposed edges of the pieces of fabric 45*a* and 45*b* may be cut along straight lines, as shown, or alternatively may be cut along a curved line. The teeth 44 are held at a fixed spacing by linking strips 46 (see FIG. 9) adjacent to the centre line of the set 42*a* or 42*b*.

In plan view each tooth 44 has a convex front face 47*a* and a concave rear face 4*b*, which in this example are of substantially the same radius of curvature. So as shown when the zip fastener 40 is closed, the teeth 44 of one set 42*a* fit between the successive teeth 44 of the other set 42*b*. The spacing between successive teeth 44 is sufficient to allow some play, so that one tooth 44 can move angularly relative to the adjacent tooth through at least a limited angle, typically no more than 30° while the zip fastener 40 remains closed, and the teeth 44 can move angularly in either direction relative to the centre line.

Referring now to FIG. 9, the linking strips 46 in the zip fastener 40 have a zigzag form. Referring now to FIG. 10, this shows the underside of the set 42*a* of teeth 44 shown in FIG. 9, to a larger scale. Each tooth 44 has a thicker portion 50 which defines a slit (not shown) in its edge, into which the fabric 45*a* is fixed. There is then a step 51 in the underside of the tooth 44, and the remaining portion 52 of the tooth is thinner. The linking strip 46, between one tooth 44 and the next, follows a shallow-V path, the two parts of this path being respectively inclined at +20° and −20° to the centre line of the set 42*a*. An edge of the linking strip 48 lines up with the step 51 on the underside of the tooth 44 at one end, and lines up with the step 51 on the underside of the tooth 44 at the other end. The step 51 also therefore follows a shallow-V path.

The thicker portion 50 also defines a small projecting flange 53 which projects beyond the rear face 47*b* of the tooth 44, and is integral with the linking strip 46.

The opposed set 42*b* of teeth 44 have the same shape, but as a mirror image.

Consequently when the zip fastener 40 is closed, the teeth 44 on one set 42*a* fit between the teeth 44 on the other set 42*b*; the linking strips 45 on the set 42*b* cross the thinner portions 52 of the teeth 44 of the set 42*a*; and the abutting faces of the linking strips 46 and of the steps 51 form a continuous zigzag along the underside of the zip fastener 40. The shallow-V of the step 51 on the underside of a tooth 44 of the set 42*a* locates the shallow-V of the linking strip 46 of the set 42*b*. The projecting flanges 53 abut the thinner portion 52 of the adjacent tooth 44, and so prevent rotation of the teeth 44 about an axis aligned with the centre line.

As shown in FIG. 8, the zip fastener 40 also includes a slider 55, which operates in an equivalent way to the slider 25 described above. The internal structure of the slider 55 is shown in more detail in the sectional views of FIGS. 11*a* and 11*b*; in which FIG. 11*a* is taken near the underside of the slider 55, and FIG. 11*b* is near the top surface of the slider 55, looking upwards in both cases. The slider 55 consists of two arrowhead-shaped guide plates 56 linked by a strut 57 at the left-hand end (as shown), and the right-hand portions of the guide plates 56 define curved internal flanges 58. The width of the gap 50 between the opposite flanges 58 is equal to the width of the teeth 44, so the closed zip fastener 40 can fit through the gap 59. The strut 57 has an upper portion 60 and a lower portion 61; the upper portion 60 (as shown in FIG. 11*b*) is teardrop shaped, whereas the lower portion 61 is significantly larger, and defines a projecting Y-shaped cam with a rounded tip 62. These components are all integral.

The sectional views of FIGS. 11*a* and 11*b* also show parts of two successive teeth 44 as they pass into the slider 55. It is thus apparent that the teardrop-shaped upper portion 60 guides the teeth 44 into or out of the slider 55, as the width of the channel between the adjacent flange 58 and the portion 60 is sufficient to allow the teeth 44 to pass; and the lower portion 61 also guides the teeth 44 as the thicker portion 50 and the linking strip 46 fit between the curved surface of the lower portion 61 and the adjacent flange 58. Accurate alignment of the teeth 44 is ensured because the thinner portion 52 of the tooth passes above the lower portion 61, whereas the linking strip 46 and the thicker portion 50 pass between the lower portion 61 and the adjacent flange 58, in an alternative slider, the teardrop-shaped upper portion 60 is replaced by a smaller cylindrical rod.

As previously explained, the abutting faces of the linking strips 46 and of the steps 51 form a continuous zigzag along the underside of the rip fastener 40. When the slider 55 is being used to open the zip fastener 40, the rounded tip 62 slides between the abutting faces of the linking strips 46 and the steps 51 and so pushes the teeth 44 apart, separating the set 42*a* from the set 42*b*.

Since the teeth 44 are field at the appropriate separation by the linking strips 46, and are free to undergo angular movement relative so the adjacent teeth 44, the zip fastener 40 can be arranged to follow a curved path, in the same way as the zip fastener 10.

It will be appreciated that the zip fastener 40 may be modified in various ways, and in particular the linking strips 46 might instead be straight, from one tooth 44 to the next. In one embodiment, in one set of teeth, the linking strips 46 are straight, and oriented at +20° to the centre line, whereas the steps 51 are straight, and oriented at −20° to the centre line; and the other set of teeth are a mirror image. It is therefore thus again the case that the abutting races of the linking strips 46 and the steps 51 form a continuous zigzag along the underside of the zip fastener.

In some garments, such as jackets, it is necessary to be able to separate the two halves of the zip fastener. Referring now to FIG. 12 there is shown a zip fastener 63 which is a modification to the zip fastener 40 (the slider 55 not being shown), consisting of opposed sots 42*a* and 42*b* of tooth 44. The right-hand portion (as shown) is as described above; but the left-hand portion (as shown) includes starting teeth 44*a* and 44*b* which are larger than the other teeth 44. The starting teeth 44*a* and 44*b* can be separated once the remainder of the zip fastener 63 has been undone; and can be reconnected to initiate reconnection of the zip fastener 83.

Referring to FIGS. 13*a* and 13*b*, these show the top and bottom views of the end portion of the set 42*a* that includes the starting tooth 44*a*; while FIGS. 13*c* and 13*d* show the top and bottom views of the end portion of the set 42*b* that includes the starting tooth 44*b*. The starting tooth 44*a* it as a convex from face 47*a*, which also defines a thin projecting arcuate flange 69 which is somewhat wider on the underside than on the top. The starting tooth 44*b* has a convex front face 47*a* to engage the concave rear face 47*b* of the adjacent tooth 44 of the set 42*a*, and this also includes a projecting tab 64 near the bottom. The starting tooth 44*b* also has concave rear face 47*b* to engage the front face 47*a* of the starting tooth 44*a*, which also includes projecting end tabs 55 near the top and a projecting tab 65*a* near the bottom. The starting tooth 44*a* is joined to the remainder of the set 42*a* by a linking strip 67 which is a continuation of the linking strip 48. The starting tooth 44*b* is pined to the adjacent tooth 44 of the set 42*b* by the linking step 46; and the underside of the starting tooth 44*b* defines a step 68 against which the linking strip 57 fits when the starting teeth 44*a* and 44*b* are fitted together.

Hence the starting tooth 44*b*, when presented at an angle, can slide along an arcuate path, engaging the front face 47*a* of the starting tooth 44*a* and engaging the rear face 47*b* of the next tooth 44, until the linking strip 8 comes up against the step 68. The end tabs 65 and the projecting tab 65*a* engage on either side of the projecting flange 69, ensuring that the starting teeth 44*a* and 44*b* remain in a common plane. Similarly the projecting tab 64 engages the rear surface of the adjacent tooth 44, preventing rotation out of that common plane. The zip fastener 53 can be used with the slider 55, as the starting tooth 44*b* can pass through the slider 55 (following the other teeth 44), while the starting tooth 44*a* cannot pass through the slider 55 by virtue of protruding shoulders 65 on either side, so the slider 55 remains attached to the set 42*a* when the zip fastener 53 is disconnected.

Referring now to FIGS. 14 to 16, there is shown a third zip fastener 70 which is a modification to the zip fastener 40, identical components being referred to by the same reference numerals, it differs primarily in having teeth 74 whose mating faces are V-shaped rather than smooth curves, so each tooth 74 has a chevron shape. The teeth 74 are at such a separation that they just touch each other at the centre of the chevron, but the chevrons are shaped so that there is a wedge-shaped gap on each side of the centre, so allowing angular movement of one tooth 74 relative to the next.

As with the fastener 40, the linking strips 46 are shallow-V shaped, and the underside of the teeth 74 defines a shallow-V shaped step 51 between a thicker portion 50 and a thin portion 52. The thicker portion 50 defines a small projecting flange 53. Hence, as shown in FIG. 15, along the underside of the rip fastener 70 the abutting faces of the linking strips 45 and the steps 51 define a continuous zigzag down the centre line of the zip fastener 70.

Referring now to FIGS. 17 and 18 there is shown a fourth zip fastener 80 in the closed position (and without showing the slider). The zip fastener 80 consists of two opposed sets 82*a* and 82*b* of teeth 84. Although the sets 82*a* and 82*b* are shown as extending in a straight line, they can also follow a curved line. Along the outer edges of the sets 82*a* and 82*b* the teeth 84 are attached to respective pieces of fabric 85 which the zip fastener 80 can join together. The fabric 85 may be stretchable, as it does not hold the teeth 84 in position; the opposed edges of the pieces of fabric 85 may be cut along straight lines, as shown, or alternatively may be cut along a curved line. The teeth 84 are held at a fixed spacing by linking strips 86 (shown in more detail in FIG. 19) adjacent to the centre line of the set 82*a* or 82*b*.

In plan view each tooth 34 has an S-shaped face 87*a* and a convex face 87*b* facing in opposite directions. The set 82*b* is the same as the set 82*a*, but oriented in the opposite direction. When the zip fastener 80 is closed, the teeth 84 of one set 82*a* fit between the successive teeth 84 of the other set 32*b*. The spacing between successive teeth 84 is sufficient to allow some play, so that one tooth 84 can move angularly relative to the adjacent tooth through at least a limited angle, typically no more than 30°, the play between convex surfaces 87*b* of adjacent teeth 84 enables the zip fastener 80 to follow a curve. The S-shaped faces 87*a* of adjacent teeth 84 engage with each other, and inhibit any relative lateral movement of one set 82*a* relative to the other set 82*b*; the convex faces 87*b* of adjacent teeth 84 contact each other, preventing axial movement.

Referring now to FIG. 19, the linking strips 86 have a zigzag form. Each tooth 84 has a thicker portion 90 which defines a slit (not shown) in its edge, into which the fabric 85 is fixed. There is then a step 91 in the underside of the tooth 84, and the remaining portion 92 of the tooth is thinner. The linking strip 86, between one tooth 84 and the next, follows an asymmetrical shallow-V path, with a longer part of this path being inclined at +10° to the centreline of the set 82*a*, and a shorter part inclined at about −25° to the centre line of the set 82*a* or 82*b*. An edge of the linking strip 86 lines up with the step 91 on the underside of the tooth 84 at one end, and lines up with the step 91 on the underside of the tooth 84 at the other end. The step 91 also therefore follows an asymmetrical shallow-V path.

When disconnecting the zip fastener 80 (using a slider similar to the slider 55 described above), the more steeply-inclined shorter part of the zigzag achieves rapid relative rotation of adjacent teeth 84, the linking strip 88 moving across the thinner portion 92 of the adjacent tooth 84, so the S-shaped faces 87*a* of adjacent teeth 84 are disengaged quickly from each other. The more gently-inclined longer part of the zigzag achieves less relative rotation of adjacent teeth 84, but this corresponds to the disengagement of the convex laces 87*b*. The different angles of the successive sections of zigzag to the centre line thus give different mechanical advantages, appropriate to disengaging the different teeth.

Referring now to FIGS. 20 and 21 there is shown a fifth zip fastener 100 in the closed position (and without showing the slider). The zip fastener 100 consists of two opposed sets 102*a* and 102*b* of teeth 104*a* and 104*b*. Although the sets 102*a* and 102*b* are shown as extending in a straight line, they can also follow a curved line. Along the outer edges of the sets 102*a* and 102*b* the teeth 104 and 104*b* are attached to respective pieces of fabric 105 which the zip fastener 100 can join together. The fabric 105 may be stretchable, as it does not hold the teeth 104*a* or 104*b* in position; the opposed edges of the pieces of fabric 105 may be cut along straight lines, as shown, or alternatively may be cut along a curved line. The teeth 104*a* are held at a fixed spacing by linking stops 106*a* (shown in more detail in FIG. 22) adjacent to the centre line of the set 102*a*; similarly the teeth 104*b* are held at a fixed spacing by linking strips 106*b* adjacent to the centreline of the set 102*b*.

In plan view each tooth 104*a* is shaped to represent a skull, and both its front and rear surfaces are convex. Each tooth 104*b* is shaped to represent crossbones, and both its front and rear surfaces are concave. As shown in FIG. 20, when the zip fastener 100 is closed, a line of alternating skulls and cross bones is shown, because the teeth 104*b* showing crossbones fit between the teeth 104*a* showing skulls, and vice versa. The spacing between successive teeth 104*a* and 104*b* is sufficient to allow some play, so that one tooth 104*a* or 104*b* can move angularly relative to the adjacent tooth 104*a* or 104*b* through at least a limited angle, typically no more than 30°. Since the adjacent teeth 104*a*, 104*b* have adjacent faces that are convex and concave, the adjacent teeth 104*a* and 104*b* engage with each other, and inhibit any relative lateral movement of one set 102*a* relative to the other set 102*b*.

The linking strips 105*a* between successive teeth 104*a* (i.e. the skull shapes) follow a curved path between the bottom left and the top left of the teeth 104*a* (as shown in FIG. 21), which ensures that successive teeth 104*a* can be separated sufficiently to allow the teeth 104*b* to be disconnected. The linking strips 106*b* between the teeth 104*b* follow a path which is almost straight, parallel to the centreline, with a very shallow V; these features are shown in more detail in FIG. 22. Each tooth 104*a*; 104*b* has a thicker portion 110*a*, 110*b* to which the fabric 105 is fixed (for example within a slot). There is then a step 111*a*, 111*b* in the underside, and the remaining portion 112*a*, 112*b* of the tooth 104*a*, 104*b* is thinner. As shown in FIG. 22, showing the underside of the assembled zip fastener 100, the longitudinal shape of the step 111*a* or 111*b* is a smooth curve, and is aligned at each end with the linking strips 106*a* or 106*b* that are connected to that tooth 104*a* or 104*b*; consequently the step 111*a* defines a bulge, in particular, the curved linking strips 106*a* locate beneath the thinner portion 112*b* of the teeth 104*b*, but do not abut the step 111*b*; the linking strips 106*b* similarly locate beneath the thinner portion 112*a* of the teeth 104*a*, and the apex of the shallow V abuts the bulge of the step 111*a* whereas the remainder of the linking strip 106*b* does not contact the step 111*a*.

The zip fastener 100 is used along with a slider 115 as shown in FIGS. 23 and 24, similar to the slider 55 of FIG. 11*a* and FIG. 11*b* described above, in that if consists of two arrowhead-shaped guide plates 56 linked by a strut 57 at the top end (as shown in FIG. 23), and the guide plates 56 define curved internal flanges 58. The strut 5 has a cylindrical upper portion 116 and a lower portion 117; the lower portion 117 is significantly larger, and defines a projecting V-shaped cam with a rounded tip 118. These components are all integral. FIG. 23 shows the underside view of the slider 115, whereas FIG. 24 shows a view corresponding to that on the arrow 24, but showing the slider 115 the right way up, and consequently the left-hand side of FIG. 23 corresponds to the right-hand side of FIG. 24. The internal flanges 58 on both sides of the upper guide plate 58 and on the right-hand side of the lower guide plates 58 (as shown in FIG. 24) are of equal widths. The internal flange 58*a* on the lower guide plate 56 on the left hand side (as shown in FIG. 24) is thicker.

When undoing the zip fastener 100, the tip 118 of the lower portion 117 pushes between the linking strips 108*a* or 106*b* and the steps 111*b* or 111*a*, causing the successive teeth 104*a* and 104*b* to undergo relative rotation so that the engaging surfaces come out of engagement, and the linking strips 106*a*, 106*b* move across the thinner portion 112*b*, 112*a* of the adjacent tooth 104*b*, 104*a*, so teeth 104*a* and 104*b* are disengaged. When doing up the zip fastener 100, the teeth 104*a* and 104*b* undergo substantially the same movements in reverse, being guided in this case partly by the internal flanges 58, 58*a*. The flange 58*a* ensures that, the teeth 104*a* are pushed closer towards the centre line, as the teeth 104*a* are somewhat narrower than the teeth 104*b*.

The tip 118 of the lower portion 117 thus acts as a cam to push the teeth 104*a* and 104*b* apart as she zip fastener 100 is undone, and the shapes of the steps 111*a* and 111*b* are different, providing different mechanical advantages when disengaging the different-shaped successive teeth.

It will be appreciated that when the zip fastener 100 is closed, the length of the zip fastener 100 (along its centreline) is determined by the dimensions of the teeth 104*b* and of the linking strips 108*b*. Although the linking strips 108*b* have a shallow V, they cannot significantly change in length because the apex of the shallow V abuts the bulge of the step 111*a*. Hence, in its closed state, the zip fastener 100 is of substantially constant length along its centreline. In contrast, during opening and closing, the teeth 104*a* and 104*b* can rotate relative to each other by virtue of the flexibility of the linking stops 106*a* and 106*b*. In particular, as one tooth 104*a* is rotated relative to the successive tooth 104*a* during opening, the curved linking strip 106*a* becomes straighter, increasing the axial gap between the teeth 104*a* sufficiently to allow disengagement from the teeth 104*b*.

It will be appreciated that the zip fastener 100 could have teeth with different decorative shapes other than skulls and crossbones. Indeed there could be multiple different teeth with different decorative shapes within a single zip fastener. For each tooth the shape of the step on the underside would preferably be such as to provide an appropriate mechanical advantage when disengaging that tooth from the adjacent tooth.

Referring now to FIG. 25 there is shown a sixth zip fastener 120 in the closed position. Structurally this has similarities to the zip fastener 40 of FIGS. 8-10, as regards the shape of the linking stops 46, but it differs in the shape of the teeth. The zip fastener 120 consists of two opposed sets 122*a* and 122*b* of teeth; and includes a slider 135. Although the zip fastener 120 is shown as extending in a straight line, it can also follow a curved line. Along the outer edges of the sets 122*a* and 122*b* the teeth 124 are attached to respective pieces of fabric (not shown). The teeth 124 are held at a fixed spacing by linking strips 46 (see FIGS. 26, 27*a* and 27*b*) adjacent to the centre line of the set 122*a* or 122*b*.

In plan view each tooth 124 is approximately rectangular, and the upper surface of each tooth 124, as shown in particular in FIG. 27*a*, has a raised portion 128 in the shape of a heart. Each tooth 124 has a double-convex front face 127*a*, matching the shape of the top of the heart, and a concave rear face 127*b* with a small protrusion 128 at the middle corresponding to the point at the bottom of the heart. The opposed sets 122*a* and 122*b* of teeth 124 have the same shape, but one is a mirror image of the other. So when the zip fastener 120 is closed, the teeth 124 of one set 122*a* fit between the successive teeth 124 of the other set 122*b*, and the faces 127*a* and 127*b* interlock to prevent lateral movement. The spacing between successive teeth 124 is sufficient to allow some play, so that one tooth 124 can move angularly relative to the adjacent tooth through at least a limited angle, typically no more than 30°. As shown in FIG. 25, the appearance of the zip fastener 120 is of a continuous line of hearts.

Referring now to the underside, as shown in FIG. 26, the linking strips 48 in the zip fastener 120 follow a zigzag path. Referring now to FIG. 27*b*, each tooth 124 has a thicker portion 130, and there is a slit 129 (see FIG. 27*a*) between the top of the portion 130 and the raised portion 125 into which the fabric would be fixed. There is then a step 131 in the underside of the tooth 124, and the remaining portion 132 of the tooth is thinner. The linking strip 46, between one tooth 124 and the next, follows a shallow-V path, the two parts of this path being respectively inclined at +20° and −20° to the centre line of the set 122*a*. An edge of the linking stop 46 lines up with the step 131 on the underside of the tooth 124 at one end, and lines up with the step 131 on the underside of the tooth 124 at the other end. The step 131 also follows a shallow-V path.

The zip fastener 120 operates in substantially the same way as described above when the slider 135 is moved along it. It will also be appreciated that the heart shapes are decorative features, and that alternative decorative shapes may be provided.

Thus the zip fastener 120 can be considered as an example of a three-layer zip fastener, the lop layer (corresponding in this case to the raised portion 126) being primarily decorative; the middle layer (corresponding to the teeth 124) providing the interlocking function, and optionally also providing a surface that the slider 135 can push against when closing the zip fastener, and the bottom layer-corresponding to the linking strips 46 and the steps 131) being the part primarily concerned with interaction with the slider 135, in which the wedge or cam (corresponding for example to the cam with the rounded tip 62 of FIG. 11*a*) runs against the faces of the linking strips 46 and the steps 131 to open the zip fastener, while the slider rails (corresponding to the internal flanges 58 of FIG. 11*a*) push on the outer edges of the teeth to close the zip fastener. If will be appreciated that outer edges of the teeth which push against the slider rails during closing (if these are in the top layer) may be a different shape to the edges of the teeth of the middle layer.

Referring now to FIG. 28 there is shown a seventh zip fastener 140 in the closed position. The zip fastener 140 consists of two opposed sets 142*a* and 142*b* of teeth; and includes a slider 155. Although the zip fastener 140 is shown as extending in a straight line, it can also follow a curved line. Along the outer edges of the sets 142*a* and 142*b* the teeth 144*a* and 144*b* are attached to respective pieces of fabric (not shown). The teeth 144*a* and 144*b* are held at a fixed spacing by linking strips 146*a* and 146*b* (see FIGS. 29, and 30*a* to 30*d*). As is evident from FIG. 29, when the zip fastener 140 is closed, the linking strips 146*a* and 146*b* are on either side of the centre line of the zip fastener 140.

In plan view each tooth 144*a* has the appearance of a tick, whereas each tooth 144*b* is circular; as shown in FIG. 30*b* each tooth 144*b* also defines a step 147*b* in its periphery. The teeth 144*a* and the teeth 144*b* may be of different coloured materials.

As shown in FIG. 30*d*, considering the underside, the longer side of each tick-shaped tooth 144*a* defines a thick portion 150 immediately adjacent to the linking strip 146*a*, the underside of this thick portion 160 being flush with the underside of the linking strips 146*a*; the thick portion 150 terminates as a step 151, and the remaining portion 152 is somewhat thinner; the thicker portion 150 also defines a slit 153 info which the edge of the adjacent fabric would be inserted, so that the thinner portion 152 lies above the fabric. Considering the other side of each tick-shaped tooth 144*a*, the thick portion 150 terminates at a second step 154 which is aligned with one edge of the linking strip 146*a* so as to define a continuous line, so that the portion of the tooth 144*g* on the other side of the linking strip 146*a* is mostly of the same thickness as the thinner portion 152, but includes a raised block 147*a* whose outer portion 155 is chamfered.

As shown in FIG. 30*b*, each tooth 144*b* defines a slit 148 in its outer face into which the edge of the adjacent fabric would be inserted. As shown in FIG. 30*a*, showing the underside, the underside of the outer portion of each tooth 144*b* is coplanar with the underside of the linking strips 146*b*, and there is a step parallel to the edge of the linking strip 146*b*. The remainder of the inner portion of each tooth 144*b* is thinner, and is chamfered, to provide a location for the linking strips 146*a* when the zip fastener 140 is closed.

As shown in FIG. 29, when the zip fastener 140 is closed the continuous line defined by the linking strips 145*a* and the steps 154 runs alongside the line defined by the steps 149. The linking strips 146*a* lie adjacent to the steps 154; while the linking strips 146*b* lie under the raised block 147*a*. During the closure process, the raised block 147*a* passes between successive cylindrical teeth 144*b*, parts of the thinner portion 152 of the tick-shaped tooth 144*a* therefore passing over the top surface of the cylindrical teeth 144*b*; and the chamfered portion 155 of the block 147*a* sliding over the linking strip 146*b*. Hence an edge of the block 147*a* engages with the step 147*b*, while the thick portion 150 engages with an outer curved surface of the cylindrical tooth 144*b*, interlocking and so preventing lateral movement. The spacing between successive teeth 144*a* and 144*b* is sufficient to allow some play, allowing restricted relative angular movement of adjacent teeth 144*a* and 144*b* through at least a limited angle, typically no more than 30°.

The zip fastener 140 operates in substantially the same way as described above when the slider 155 is moved along it. However in this case the slider 155 is distinguished from the slider 55 of FIGS. 11*a* and 11*b* primarily in that although there are internal flanges 58 on both sides of the lower guide plate 56, and on one side of the upper guide plate 56, there is no internal flange 58 on the other side of the upper guide plate (as shown in the underside view of FIG. 29), to allow the projecting parts of the tick-shaped teeth 144*a* to pass through the slider 155.

It will be appreciated that the various different zip fasteners 10, 40, 63, 70, 60, 100, 120 and 140 are given by way of example only, and may be amended in various ways, for example incorporating features from other designs. For example wherever it is necessary for the two halves, that is to say the two sets of teeth of a zip fastener, to be taken completely apart, then this may be achieved using teeth analogous to the starting teeth 44*a* and 44*b* which feature in the zip fastener 63. To suppress the risk of teeth rotating about the centre line, all the teeth in a zip fastener may be provided with tabs or flanges equivalent to the thin projecting arcuate flange 69 and the projecting end tabs 65 and projecting tab 65*a* as provided in the starting teeth 44*a* and 44*d*. In another modification, if a firmer connection to the fabric is required, then each tooth may be additionally provided with a slotted lab or its outside edge, the slot in the lab aligning with the slit in the outside of the tooth, and the fabric being connected to the slotted tab as well as to the slit as described above. This increases the area of contact with the fabric. Other ways of attaching the teeth to the fabric may also be applied. The fabric may be joined to the top, bottom, or side of the teeth.

The zip fasteners 40, 63, 70, 80 and 120 use linking strips that in combination define a zigzag. This may enable the teeth to be connected at the optimum positions with regard to mechanical strength; and inherently provides some longitudinal resilience, so that the zip fastener can more readily go along a curved path. In each of these examples the teeth may be moulded onto the fabric during manufacture, in which case the teeth would not have to define a slit to accommodate the fabric, as the fabric would be embedded in the tooth during manufacture; for example the slit 148 of the zip fastener 140 may be occupied by the fabric as the teeth 144*b* are made. If the teeth are moulded onto the fabric during manufacture, then each of these designs of zip fastener does not necessitate any undercuts, and so can be manufactured using a comparatively simple moulding tool.

In each zip fastener 10, 40, 63, 70, 80, 100, 120 and 140 the use of the linking strips maintains the teeth at the desired spacing, allowing use of fabric which can stretch. In some cases a strip of fabric (to which the zip fastener is to be attached) may be pre-stretched before the teeth are attached. The linking strips and the teeth may be formed by an injection moulding process, using a flexible polymeric material, optionally with a fibre filler to enhance strength. Alternatively the linking strips (as in the zip fastener 10) may define a continuous strip, onto which the teeth are subsequently moulded or fixed by adhesive, welding or other bonding method. In some cases the fabric strips may extend to the centre line of the zip fastener, and be integral with the linking strips, in that case the portion of the fabric strip that is integral with the linking strips would not be stretchable, whereas the remaining portion of the fabric strip may be a longitudinally extensible.

It will also be appreciated that in each case a flexible strip of fabric or of sheet polymer (which may contain fibre filler) may be fixed to the outside of the zip fastener, in place of the fabric mentioned above; and the flexible strip itself may then be joined to a piece of fabric using known bonding techniques.

The zip fasteners 10, 40, 63, 70, 80, 100 and 120 have opposed sets of teeth that are linked together so that the closed zip fastener can follow a curved path as illustrated in FIG. 5. The fixed spacing of the teeth is maintained by the linking strips, so the fabric to which the zip fasteners are attached can be extensible in the longitudinal direction, i.e. parallel to the centre line of the zip fastener. The fabric may also be extensible in a transverse direction.

Considering a zip fastener following a curved path, the centre line of the zip fastener is of fixed length (determined by the lengths of the interlocking teeth, and by the linking strips), so that on the inside of the curve, the fabric must become shorter, while on the outside of the curve the fabric must become longer. Puckering of the fabric on the inside of the curve can be avoided by using longitudinally extensible fabric tapes along each side of the zip fastener, the teeth and the linking strips being attached to the fabric tapes while the tape is under tension (and may be straight). In some cases the linking strips may be integral with the fabric tapes. If the zip fastener is connected together, and shaped to follow a curved path, the concave section on the inside of the curve can then relax from its pre-tensioned length, while the convex section on the outside of the curve can stretch to more than its pre-tensioned length. This ensures that the fabric on both the inside and the outside of the curve can remain flat, without puckering. By way of example the fabric may be stretched to between 40% and 60% for example 50% of its maximum extension before the teeth are attached. This ensures that the portion of the fabric on the outside of the curve can be stretched further, while also ensuring that the portion of the fabric on the inside of the curve can contract adequately. In practice the fabric may be stretched to a lesser extent, for example to between 5% and 40% of its maximum extension, for example to 20% or 30% of its maximum extension, before the teeth are attached.

It will be appreciated that the length of the centre line determined by the linking strips would therefore be longer than the relaxed length of the fabric tapes.

By way of example, if the width of each strip of fabric is W, and the radius of curvature of the inside edge is R, then the arc lengths along the inside edge, the centre line, and the outer edge of she zip fastener are proportional to: R; (R+W) and (R+2W) respectively. So if the inside edge is unstretched, the percentage stretch, S, along the outer edge is:

$$S=(2W/R)\times 100\%$$

Hence if the fabric has a maximum percentage stretch of $S_m$ then the minimum radius of curvature $R_m$ along the inner edge is:

$$R_m=2W\times(100\%/S_m)$$

It therefore follows that the minimum radius of curvature $C_m$ along the centre line is;

$$C_m=(2W\times(100\%/S_m))+W$$

It will be appreciated that once the zip fastener has been made, and shaped into the required curve, the fabric strips on each side may be processed to remove their extensible properties, for example by heat setting, melding of a proportion of the constituent yarns within the fabric strips, or by adhesive or other treatment, it is thus feasible to create a zip fastener that follows a curved path, and has a relaxed, pucker-free carrier tape of fabric on each side.

What is claimed is:

1. A zip fastener comprising two opposed sets of teeth; the teeth being shaped such that the teeth on one set can fit between the teeth on the other set, at least some adjacent teeth of the opposed sets having facing surfaces shaped so as to engage and to inhibit separation of the opposed sets, such that when the teeth fit together the shaped facing surface on one tooth is adjacent to the shaped facing surface of an adjacent tooth that engages with it to inhibit separation, and such that each tooth can undergo at least limited angular movement relative to the adjacent tooth when the zip fastener is closed; wherein the teeth within each one of the opposed sets are held at a predetermined spacing along each one of the opposed sets by a linking strip aligned generally along a center line of each one of the opposed sets; and wherein each tooth defines a strip location such that the linking strip on one of the opposed sets of teeth can be disposed in the strip location on the other set, wherein the strip location is configured to receive the opposed set of teeth;

wherein either:

the linking strips extend along the center line, the linking strips on the opposed sets of teeth being directly underneath each other when the zip fastener is closed, both lying on the center line; or the linking strips on the sets of teeth extend along lines that are adjacent to the center line, and the linking strips of at least one of the opposed sets of teeth abut a step in a wall within each strip location on the opposite set of teeth, when the zip fastener is closed.

2. The zip fastener of claim 1, wherein all the teeth have a convex front surface and a concave rear surface, the convex front surface and the concave rear surface constituting the engaging facing surfaces of adjacent teeth.

3. The zip fastener of claim 1, wherein the linking strips and the teeth of one of the opposed sets are integral with each other.

4. The zip fastener of claim 1, wherein the linking strips are defined by a continuous strip, onto which the teeth within each one of the opposed sets are attached.

5. The zip fastener of claim 1, wherein the strip locations on the teeth are defined by a step on each tooth.

6. The zip fastener of claim 5, wherein the strip locations of each one of the opposed sets of teeth are on an under surface or a top surface of the teeth, such that when the zip fastener is closed, the linking strips of the two opposed sets of teeth extend along lines that are adjacent to the center line, the linking strips of at least one of the opposed sets of teeth abutting a surface within each strip location on the opposite set of teeth, and the abutted surface is at least part of the step.

7. The zip fastener of claim 6, wherein the linking strips of each one of the opposed sets of teeth align with a step on each tooth of each individual one of the opposed sets of teeth, and the linking strips and the step define a continuous zigzag path.

8. The zip fastener of claim 7, wherein portions of the zigzag path are inclined at no more than 30° to the center line.

9. The zip fastener of claim 1, further comprising a slider, which when moved along the zip fastener in one direction slides the teeth one-by-one into an interlocking position, and when moved in the opposite direction slides the teeth one-by-one apart, the slider incorporating a cam element to separate successive teeth.

10. The zip fastener of claim 9, wherein the cam element is in the form of a blunt wedge.

11. The zip fastener of claim 10, wherein the cam element engages with a step on each tooth.

12. The zip fastener of claim 10, wherein the linking strips of each one of the opposed sets of teeth align with a surface feature on each tooth of each individual one of the opposed sets of teeth, and the linking strips and the surface feature define a continuous zigzag path, and wherein the cam element engages with the continuous zigzag path defined by both the linking strips and the surface feature.

13. The zip fastener of claim 1, incorporating two fabric strips to which the opposed sets of teeth are attached, one of the opposed sets of teeth being attached to each fabric strip, wherein at least a portion of the fabric strip is stretchable, and the fabric strip is pre-stretched before the teeth are attached.

14. The zip fastener of claim 13, wherein the fabric strip is pre-stretched to between 5% and 60% of its maximum extension before attachment of the teeth.

15. The zip fastener of claim 13, wherein the stretchable portion of the fabric strip has a relaxed length that is shorter than a length of one of the opposed sets of teeth.

* * * * *